US005893003A

United States Patent [19]

Allen

[11] Patent Number: 5,893,003

[45] Date of Patent: Apr. 6, 1999

[54] COMPENSATION METHOD AND SYSTEM FOR DENSITY LOSS IN AN IMAGING APPARATUS

[75] Inventor: John J. Allen, Mendota Heights, Minn.

[73] Assignee: Imation Corp., Oakdale, Minn.

[21] Appl. No.: 941,095

[22] Filed: Sep. 30, 1997

[51] Int. Cl.[6] ..... G03D 7/00

[52] U.S. Cl. ..... 396/575; 219/216

[58] Field of Search ..... 396/575, 578; 355/30, 27–29; 219/216; 250/318; 430/203

[56] References Cited

U.S. PATENT DOCUMENTS

| | | | |
|---|---|---|---|
| 3,690,015 | 9/1972 | Umahashi et al. | 34/95 |
| 4,194,826 | 3/1980 | Lewis | 396/575 |
| 4,686,351 | 8/1987 | Nakauchi | 219/216 |
| 5,066,562 | 11/1991 | Nakamura | 250/318 |
| 5,414,488 | 5/1995 | Fujita et al. | 355/27 |
| 5,502,532 | 3/1996 | Biesinger | 396/575 |

FOREIGN PATENT DOCUMENTS

| | | |
|---|---|---|
| 1-073341 | 3/1989 | Japan . |
| 7-199439 | 4/1995 | Japan . |
| WO 95/30934 | 11/1995 | WIPO . |

*Primary Examiner*—D. Rutledge
*Attorney, Agent, or Firm*—William K. Weimer

[57] ABSTRACT

A method and system for compensating for density loss in an imaging apparatus while sequentially developing a plurality of photothermographic elements. In one embodiment, the present invention compensates for thermal energy dissipated while developing each of a plurality of photothermographic element. In another embodiment, the present invention compensates for thermal energy transferred from a heated member to indirectly heated components, such as the pressure rollers, between development cycles. The present invention achieves a more accurate characterization of the thermal energy stored by the imaging apparatus throughout the imaging sequence. In this manner, a more uniform density is achieved for all of the photothermographic elements of the imaging sequence.

16 Claims, 3 Drawing Sheets

COMPENSATION METHOD AND SYSTEM FOR DENSITY LOSS IN AN IMAGING APPARATUS

FIELD OF THE INVENTION

This invention relates generally to the field of imaging, and more particularly to a method and system for compensating for density loss in an imaging apparatus.

BACKGROUND

An imaging system typically includes an input imaging device that generates image information, and an output imaging device that forms a visible representation of the image on an imaging element based on the image information. In a medical imaging system, for example, the input imaging device may include a diagnostic device, such as a magnetic resonance (MR), computed tomography (CT), conventional radiography (X-ray), or ultrasound device. The output imaging device in a medical imaging system typically includes a digital laser imager. The laser imager exposes the imaging element in response to the image information to form the visible representation of the image.

The image information generated by the input imaging device includes image data containing digital image values representative of the image, and imaging commands specifying operations to be performed by the laser imager. Each of the digital image values corresponds to one of a plurality of pixels in the original image, and represents an optical density associated with the respective pixel. In response to an imaging command, the laser imager converts the digital image values to generate laser drive values used to modulate the intensity of a scanning laser. The laser drive values are calculated to produce exposure levels, on the imaging element, necessary to reproduce the optical densities associated with the pixels of the original image when the element is developed.

SUMMARY OF THE INVENTION

Recently, photothermographic media has become a preferred media for providing medical images because the media may be processed thermally, thereby eliminating the need for wet chemical processing. In order to correctly reproduce the optical densities associated with the original image, the output imaging device must maintain a substantially uniform temperature while thermally developing the photothermographic element. It has been found that conventional techniques do not adequately account for temperature changes in all of the components necessary for developing photothermographic elements, especially when thermally developing large batches. More specifically, as each photothermographic element is thermally processed, there is a loss of heat in the developing components. The thermal energy dissipated by indirectly heated components, such as rollers heated by contacting a heated drum, may not be replaced before imaging the next photothermographic element. These changes in thermal energy result in reduced density in the subsequent photothermographic elements. Thus, as explained in detail below, the present invention is directed to a method and system for compensating for density loss in an imaging apparatus while developing a series of photothermographic elements.

In one embodiment, the invention is an output imaging device for sequentially imaging a plurality of photothermographic elements. The output imaging device includes a radiation source for exposing each photothermographic element. A heated member sequentially receives each of the photothermographic elements. A pressure roller is adjacent the heated member for guiding the photothermographic elements against the heated member. Furthermore, the heated member transfers thermal energy to the pressure rollers, thereby heating the pressure rollers. A controller sets a respective film dwell time for each photothermographic element such that the heated member and the pressure rollers transfer thermal energy to each of the photothermographic elements to heat the photothermographic elements to at least a threshold development temperature in order to develop an image in each of the photothermographic elements. The controller sets the film dwell time for each photothermographic element as a function of (1) the thermal energy transferred by the pressure rollers to each photothermographic element and, (2) as a function of the thermal energy transferred to the pressure rollers from the heated member.

According to one aspect of the invention, the controller sets the film dwell time for each photothermographic element according to a dwell compensation defined by the following equation:

$$D_{DWELL}=[D_{PREV}+(D_{MAX}-D_{PREV})*(1-e^{-T_H/R})]*e^{-T_D/D}$$

where $D_{PREV}$ equals a dwell compensation for a previously developed photothermographic element, $T_D$ is a period of thermal loss for the pressure roller equaling a time duration of the transfer of thermal energy to each photothermographic element, $T_H$ is a period of thermal gain for the pressure roller equaling a time duration of the transfer of thermal energy from the heated member to the pressure roller, D equals a thermal decay time constant for the pressure roller, R equals a thermal rise time constant for the pressure roller and $D_{MAX}$ is a predetermined maximum dwell compensation defined by the equation:

$$D_{MAX}=D_{SS}*[(1-e^{-T_D/R}*e^{-T_H/D})/((1-e^{-T_D/R})e^{-T_H/D})]$$

where $D_{SS}$ is an optimal dwell compensation for steady-state conditions.

According to another aspect of the invention, the controller continuously sets the film dwell time of each photothermographic element according to a dwell compensation defined by the following equation:

$$D_{DWELL}=D_{ENTER}+((D_{MAX}-D_{ENTER})*(1-e^{-t/R}))$$

where $D_{ENTER}$ equals a film dwell time calculated when the heated member received the photothermographic element, t equals an elapsed time since the heated member received the photothermographic element, R equals a rise time constant for the pressure roller and $D_{MAX}$ is the predetermined maximum dwell compensation.

According to another aspect of the invention, the controller sets the film dwell time for at least one photothermographic element by decreasing the angular rates of the heated member and pressure rollers, thereby increasing the respective film dwell time for the photothermographic element.

According to another aspect of the invention, the controller sets the film dwell time for at least one photothermographic element by increasing the angular rates of the heated member and pressure rollers, thereby decreasing the respective film dwell time for the photothermographic element.

According to another aspect of the invention, the controller periodically sets the film dwell time for at least one photothermographic element of the photothermographic elements. Additionally, the controller may set the film dwell time of each photothermographic element according to a series of discrete dwell times stored in a lookup table.

In another embodiment, the present invention is a method developing a plurality of photothermographic elements with an output imaging device having a heated member and a pressure roller adjacent the heated member for guiding the photothermographic elements against the heated member. The method includes the step of transporting a first photothermographic element between the heated member and the pressure rollers for a first film dwell time. In this manner, the heated member and the pressure rollers transfer thermal energy to the first photothermographic element to heat the photothermographic element to at least a threshold development temperature in order to develop an image in the first photothermographic. The heated member engages the pressure rollers such that thermal energy is transferred from the heated member to the pressure rollers. A second photothermographic element is transported between the heated member and the pressure rollers for a second dwell time based on (1) the thermal energy transferred to the first photothermographic element by the pressure rollers during the step of transporting the first photothermographic element, and (2) the thermal energy transferred from the heated member to the pressure rollers during the engaging step.

These and other features and advantages of the invention will become apparent from the following description of the preferred embodiments of the invention.

DETAILED DESCRIPTION

In the following detailed description, references are made to the accompanying drawings which illustrate specific embodiments in which the invention may be practiced. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents.

Figure 1:
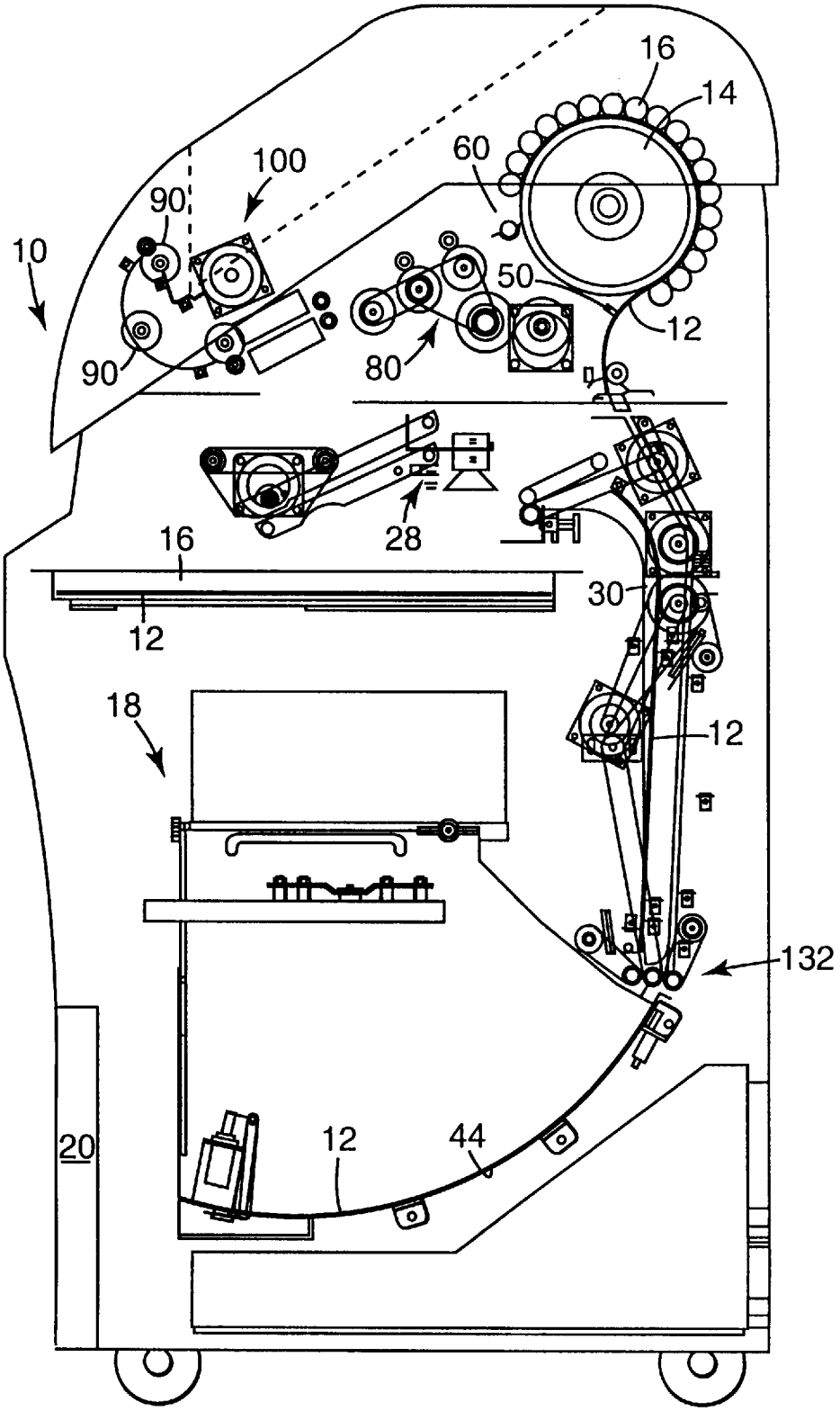
FIG. 1 is a schematic side view of one embodiment of an output imaging device that compensates for heat fluctuations over a series of development cycles in accordance with the present invention.

FIG. 1 is a schematic side view of an output imaging device 10 that compensates for heat fluctuations over a series of development cycles in accordance with the present invention. In one embodiment, output imaging device 10 is a continuous tone medical imager. As shown in FIG. 1, output imaging device 10 includes cartridge 16 containing at least one photothermographic element 12, heated member 14, an optical scanning module 18, controller 20, suction feed mechanism 28, staging area 30, film platen 44, element guide 60, cooling apparatus 80, exit rollers 90 and bin 100.

Cartridge 16 contains unexposed photothermographic elements 12. Preferably, photothermographic element 12 includes heat-developable photographic elements containing silver halide. These elements are commonly known as "dry silver" compositions or emulsions and generally comprise: (1) a photosensitive material that generates elemental silver when irradiated, (2) a non-photosensitive, reducible silver source, (3) a reducing agent for the non-photosensitive reducible silver source; and (4) a binder. Alternatively, photothermographic element 12 may be any photoreceptive element which may be thermally developed.

For each development cycle, controller 20 activates suction feed mechanism 28 such that photothermographic element 12 is transported out of cartridge 16. Photothermographic element 12 is then fed into staging area 30 where photothermographic element 12 is transported into film platen 44 for exposure with image data in a raster pattern by optical scanning module 18.

Once the scanning of the image is complete, photothermographic element 12 is transported at a transport rate out of film platen 44 and fed into the nip formed by heated member 14 and pressure rollers 16. Controller 20 commands heated member 14 and pressure rollers 16 to rotate at an angular rate causing photothermographic element 12 to rotate with heated member 14 while pressure rollers 16 guide photothermographic element 12 toward heated member 14. In this manner, photothermographic element 12 is transported between pressure roller 16 and heated member 14. The time interval that an arbitrary region of photothermographic element 12 is between pressure rollers 16 and heated member 14 depends on the angular rate of rotation. This time interval is known as a film dwell time. In one embodiment, heated member 14 rotates at 4 $\pi$ radians per minute and pressure rollers are distributed over 180° along the circumference of heated member 14. Therefore, in this embodiment the film dwell time for any arbitrary region of photothermographic element 12 is approximately 15 seconds.

Heated member 14 and pressure rollers 16 heat photothermographic element 12 to a development temperature in order to develop a latent image on photothermographic element 12. Following thermal development, element guide 60 lifts and guides photothermographic element 12 away from rotating heated member 14 and toward cooling apparatus 80. After cooling, photographic element 12 is driven by exit rollers 90 into bin 100 for retrieval by a user of output imaging device 10.

By repeating the imaging process described above, output imaging device 10 sequentially exposes and develops a plurality of photothermographic elements 12. During this process, pressure rollers 16 deliver a portion of the thermal energy required to develop each photothermographic element 12. The thermal energy stored by pressure roller 16, however, fluctuates during sequential development cycles. More specifically, pressure rollers 16 dissipate thermal energy as each photothermographic element 12 is transported around heated member 14 and developed by heated member 14 and pressure rollers 16. A period of thermal loss for pressure rollers 16 can be calculated by dividing the length of photothermographic element 12 by a linear velocity of photothermographic element 12. In one embodiment, photothermographic element 12 is 17 inches in length and has a linear velocity of 0.41 inches per second, resulting in a period of thermal loss of approximately 41 seconds.

After thermally developing photothermographic element 12, heated member 14 engages pressure rollers 16 and transfers thermal energy to pressure rollers 16 for a period of thermal restoration. The period for thermal restoration is essentially dictated by the desired throughput of output imaging device 10 and in one embodiment equals 19 seconds.

While imaging a plurality of photothermographic elements 12, heated member 14 may not be able to fully restore the thermal energy transferred by pressure rollers 16 to photothermographic element 12. As a result, poor image quality, such as reduced optical density, may be observed in photothermographic element 12 when output imaging device 10 sequentially images a plurality of photothermographic elements. In order to maintain a constant thermal energy transfer, the present invention adjusts the film dwell time of photothermographic element 12 by setting the transport rate of photothermographic element 12. In this manner, the present invention compensates for the thermal energy dissipated by pressure roller 16 over the development cycles. For example, in order to compensate for thermal energy lost by pressure rollers 16 during the thermal loss period, controller 20 decreases the angular rate of rotation for heated member 14 and pressure rollers 16, thereby increasing the dwell time of photothermographic element 12.

Figure 2:
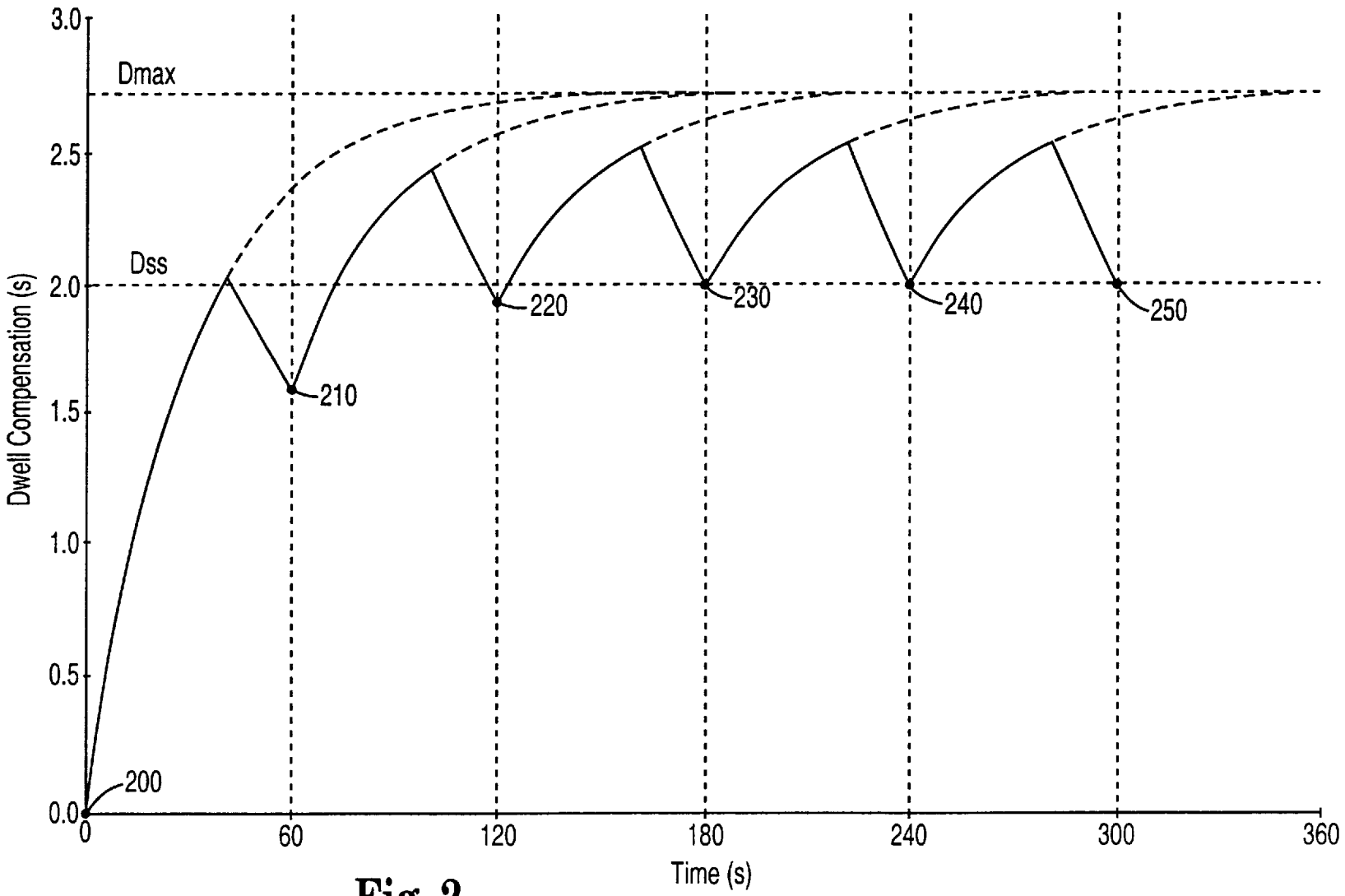
FIG. 2 is a chart illustrating a profile for increasing a film dwell time in order to compensate for heat loss over a series of development cycles in accordance with the present invention.

FIG. 2 is a chart illustrating one example of a profile for adjusting the film dwell time in order to compensate for thermal energy changes over a series of development cycles in accordance with the present invention. More specifically, FIG. 2 illustrates film dwell time compensation for six photothermographic elements 200, 210, 220, 230, 240 and 250 developed at 60 second times interval. In another embodiment, the time interval may be lowered depending upon the throughput of output imaging device 10.

Prior to developing the series of photothermographic elements, heated member 14 (FIG. 1) heats pressure rollers 16 to an initial development temperature. Therefore, controller 20 sets the transport rate of photothermographic element 200 (Fig. 2) such that photothermographic element 200 has a nominal film dwell time. In one embodiment, photothermographic element 200 has a film dwell time of 15 seconds.

After imaging photothermographic element 200, controller 20 sets the transport rate of element 210 such that element 210 experiences a corresponding film dwell time increase of approximately 1.6 seconds. As described above, this increase is primarily due to (1) the thermal energy dissipated by pressure roller 16 while element 200 is disposed between pressure roller 16 and heated member 14, and (2) the thermal energy transferred to pressure rollers 16 from heated member 14 after developing element 200. As will be discussed in detail below, these fluctuations in thermal energy stored by pressure rollers 16 result in a saw-tooth profile for dwell compensation as illustrated by FIG. 2.

After imaging photothermographic element 210, controller 20 adjusts the transport rate of element 220 such that the respective film dwell time is increased by approximately 1.90 seconds from the nominal dwell time. Similarly, controller 20 adjusts the transports rate of element 230 such that the respective film dwell time is increased approximately 2.0 seconds from the nominal dwell time. Output imaging device 10 sequentially develops photothermographic elements until each of the photothermographic elements has been processed. In this manner, optimal image density is achieved over the series of development cycles.

As illustrated in FIG. 2, the amount of thermal energy dissipated by pressure rollers 16 and the amount of thermal energy transferred by heated member 14 to pressure rollers 16 reach an equilibrium after several development cycles. More specifically, as each element 230, 240 and 250 is thermally developed by heated member 14 and pressure rollers 16, the compensation in film dwell time stabilizes to a steady-state dwell time, $D_{SS}$, the optimal dwell compensation for the steady-state condition. $D_{MAX}$ is a predetermined maximum dwell compensation that is approached as the period of thermal loss approaches infinity. Due to thermal recovery during the period of thermal restoration, however, dwell compensation converges on $D_{SS}$. In other words, $D_{MAX}$ is selected such that the dwell compensation follows the optimal dwell compensation curve for each photothermographic element.

In this manner, controller 20 sets the respective dwell increase for photothermographic elements 230, 240 and 250 to approximately 2.00 seconds. If sufficient time elapses between the development of photothermographic element 250 and a subsequent photothermographic element, such that pressure rollers 16 are fully reheated to the initial development temperature, then controller 20 sets the transport rate such that a subsequent photothermographic element experiences the nominal dwell time.

In one embodiment, output imaging device 10 achieves uniformity in the optical density of the developed image on photothermographic element 12 by continuously adjusting the film dwell time of photothermographic element 12. For example, in one embodiment, controller 20 recalculates the film dwell time compensation and corresponding transport rate for photothermographic element every 100 ms. The period of adjustment can be made substantially smaller if necessary to further improve uniformity of the optical density.

Figure 3:
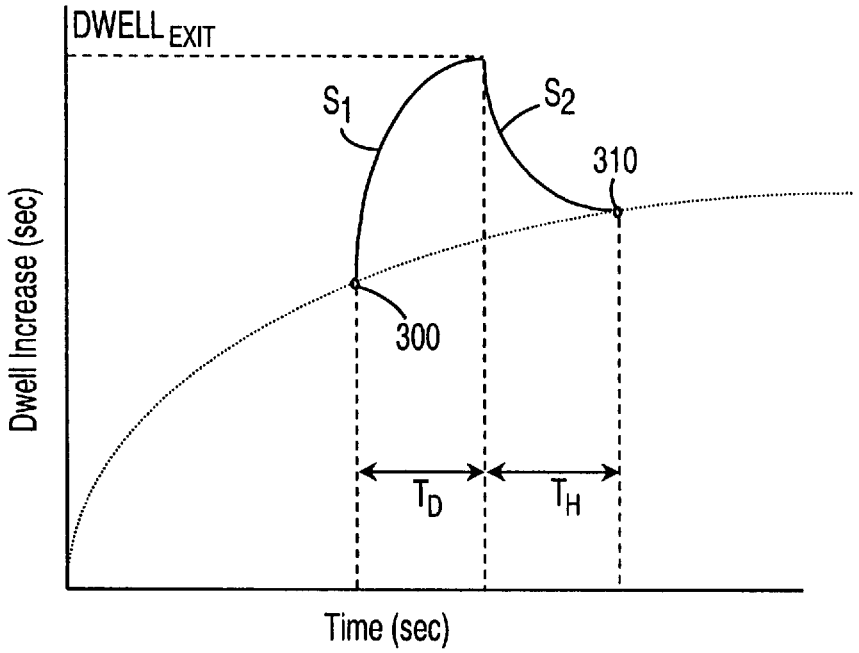
FIG. 3 is a chart illustrating in detail a rise and decay in dwell compensation during a single development cycle.

FIG. 3 is a chart illustrating in detail the manner in which an optimal dwell compensation changes throughout a single development cycle. More specifically, during the development of element 300, pressure rollers 16 (FIG. 1) experience heat loss as thermal energy is transferred to element 300 or dissipated generally. This heat loss results in an increase in the optimal dwell compensation during development of photothermographic element 300 and any subsequent photothermographic elements. This increase in optimal dwell compensation may be defined according to the thermal characteristics of pressure rollers 16 and is illustrated by curve $S_1$. The optimal dwell compensation at any point along curve $S_1$, can be profiled as:

$$D_{DWELL}=D_{ENTER}+((D_{MAX}-D_{ENTER})*(1-e^{-t/R}))$$

where $D_{DWELL}$ equals the optimal dwell compensation for element 300, $D_{ENTER}$ equals the optimal dwell compensation when heated member 14 received photothermographic element 300 and t equals an elapsed time in seconds since heated member 14 received photothermographic element 300. As described above, $D_{MAX}$ is a function of the steady-state dwell time, $D_{SS}$, and equals:

$$D_{MAX}=D_{SS}*[(1-e^{-T_D/R}*e^{-T_H/D})/((1-e^{-T_D/R})*e^{-T_H/D})]$$

where $T_D$ equals the period of thermal loss, $T_H$ equals the period of thermal restoration, D equals a decay time constant for pressure rollers 16 and R equals a rise time constant. In one embodiment, $T_D$ equals 41 seconds and $T_H$ equals 19 seconds, thereby defining a 60 second interval between photothermographic elements. Furthermore, the rise time constant, R, and the decay time constant, D, may be based on the thermal characteristics of pressure rollers 16 or may be determined empirically. In one embodiment R equals 30 and D equals 80.

After element 300 has been completely developed, heated member 12 again engages and heats pressure rollers 16, thereby causing the optimal dwell-time for a subsequent element to decrease along curve $S_2$. As with the dwell increase during development of element 300, the dwell time decrease after development of element 300 may be defined according to thermal characteristics of pressure roller 16. For example, the decrease in optimal dwell time as heated member 14 transfers thermal energy to pressure rollers 16 can be calculated as follows:

$$D_{DWELL}=D_{EXIT}*e^{-t/D}$$

where $D_{DWELL}$ equals the optimal dwell time at any point along S2, $D_{EXIT}$ equals the optimal dwell when photothermographic element 300 exited from heated member 14 and pressure rollers 16, and t equals the elapsed time in seconds since photothermographic element 300 exited from heated member 14 and pressure rollers 16.

In another embodiment, output imaging device 10 does not continuously adjust the transport rate of each photothermographic element, but sets the transport rate of each photothermographic element as it is received by heated member 14 and pressure rollers 16. As illustrated in FIG. 1, output imaging device 10 includes sensor 50 for detecting when photothermographic element 12 is being transported into the nip formed by heated member 14 and pressure rollers 16. When sensor 50 is triggered, controller 20 sets the transport rate for each photothermographic element within a series of development cycles. More specifically, the above equations can be combined into the following equation for setting the dwell time of each photothermographic element:

$$D_{DWELL}=[D_{PREV}+(D_{MAX}-D_{PREV})*(1-e^{-T_H/R})]*e^{-T_D/D}$$

where $D_{DWELL}$ equals the dwell compensation for the current photothermographic element while $D_{PREV}$ equals the dwell compensation of the previous element. In one embodiment, controller 20 calculates a transport rate for each photographic element when sensor 50 is triggered. In another embodiment, controller 20 sets the transport rate for each element by accessing a lookup table containing transport rates, or corresponding dwell times, for each photothermographic element within a series of development cycles.

CONCLUSION

Various embodiments have been described for compensating for density loss in an imaging apparatus while sequentially developing a plurality of photothermographic elements. For example, in one embodiment, the present invention compensates for thermal energy dissipated while developing each of a plurality of photothermographic element. In another embodiment, the present invention compensates for thermal energy transferred from a heated member to other developing components, such as the pressure rollers, between development cycles.

Several advantages of the present invention have been illustrated including an accurate characterization of the thermal energy stored by the developing components of an imaging apparatus throughout the imaging sequence. In this manner, a more uniform density is achieved for all of the photothermographic elements of the imaging sequence. This application is intended to cover any adaptations or variations of the present invention. It is manifestly intended that this invention be limited only by the claims and equivalents thereof.

I claim:

1. A method for developing a plurality of photothermographic elements with an output imaging device having a heated member and a pressure roller adjacent the heated member for guiding the photothermographic elements against the heated member, the method comprising the steps of:

transporting a first photothermographic element between the heated member and the pressure roller for a first film dwell time, wherein the heated member and the pressure roller transfer thermal energy to the first photothermographic element to heat the photothermographic element to at least a threshold development temperature in order to develop an image in the first photothermographic element;

engaging the pressure roller with the heated member such that thermal energy is transferred from the heated member to the pressure roller; and transporting a second photothermographic element between the heated member and the pressure roller for a second film dwell time, wherein the heated member and the pressure roller transfer thermal energy to the second photothermographic element to heat the second photothermographic element to at least the threshold development temperature in order to develop an image in the second photothermographic element, and further wherein the second dwell time is a function of the thermal energy transferred by the pressure roller to the first photothermographic element and the thermal energy transferred from the heated member to the pressure roller.

2. The method of claim 1, wherein the step of transporting the first photothermographic element comprises the step of rotating the heated member and the pressure roller at an angular rate, and further wherein the step of transporting the second photothermographic element comprises the step of adjusting the angular rate of the heated member and the pressure roller.

3. The method of claim 2, wherein the step of transporting the second photothermographic element comprises the step of decreasing the angular rate as a function of thermal energy transferred to the first photothermographic element by the pressure roller during the step of transporting the first photothermographic element.

4. The method of claim 2, wherein the step of transporting the second photothermographic element comprises the step of increasing the angular rate as a function of thermal energy transferred from the heated member to the pressure roller during the engaging step.

5. The method of claim 2, wherein the step of transporting the second photothermographic element comprises the step of adjusting the angular rate as a function of thermal energy transferred to the first photothermographic element by the pressure roller during the step of transporting the first photothermographic element and as a function of thermal energy transferred from the heated member to the pressure roller during the engaging step.

6. The method of claim 1, wherein the step of transporting the second photothermographic element comprises the step of setting the second dwell time based on the first film dwell time and a film dwell compensation stored in a lookup table of dwell compensations.

7. The method of claim 1, wherein the step of transporting the second photothermographic element further comprises the step of setting the second dwell time based on the first film dwell time and a film dwell compensation defined by the following equation:

$$D_{DWELL}=[D_{PREV}+(D_{MAX}-D_{PREV})*(1-e^{-T_H/R})]*e^{-T_D/D}$$

where $D_{DWELL}$ equals the film dwell compensation, $D_{PREV}$ equals a dwell compensation for the first photothermographic element, $T_D$ equals a period of thermal loss for the pressure roller, $T_H$ equals a period of thermal gain for the pressure roller, D equals a decay time constant for the pressure roller, R equals a rise time constant for the pressure roller and $D_{MAX}$ is a predetermined maximum dwell compensation defined by the equation:

$$D_{MAX}=D_{SS}*[(1-e^{-T_D/R}*e^{-T_H/D})/((1-e^{-T_D/R})*e^{-T_H/D})]$$

where $D_{SS}$ is an optimal dwell compensation for steady-state conditions.

8. The method of claim 1, wherein the step of transporting the second photothermographic element further comprises the step of continuously adjusting the second dwell time based on the first film dwell time and a film dwell compensation defined by the following equation:

$$D_{DWELL}=D_{ENTER}+((D_{MAX}-D_{ENTER})*(1-e^{-t/R}))$$

where $D_{DWELL}$ equals the film dwell compensation, $D_{ENTER}$ equals a dwell compensation calculated after the heated member transfers thermal energy to the pressure rollers, t equals a period of thermal loss during which the second photothermographic element is disposed between the heated member and the pressure roller, R equals a rise time constant for the pressure roller and $D_{MAX}$ is a predetermined maximum dwell compensation defined by the equation:

$$D_{MAX}=D_{SS}*[(1-e^{-T_D/R}*e^{-T_H/D})/((1-e^{-T_D/R})*e^{-T_H/D})],$$

where $T_D$ is a period of thermal loss for the pressure roller equaling a time duration of the step of transporting the first photothermographic element, $T_H$ is a period of thermal gain for the pressure roller equaling a time duration of the engaging step, D equals a decay time constant for the pressure roller.

9. An output imaging device for sequentially imaging a plurality of photothermographic elements comprising:

a radiation source for exposing each photothermographic element;

a heated member positioned to sequentially receive each of the photothermographic elements;

a pressure roller for guiding the photothermographic elements against the heated member, wherein the heated member transfers thermal energy to the pressure roller; and a controller for setting a respective film dwell time for each photothermographic element, wherein the heated member and the photothermographic element transfer thermal energy to each photothermographic element in order to heat each photothermographic element to at least a threshold development temperature so as to develop an image in each of the photothermographic elements, and further wherein the controller sets the film dwell time for each photothermographic element as a function of the thermal energy transferred by the pressure roller to each photothermographic element and as a function of the thermal energy transferred to the pressure roller from the heated member.

10. The output imaging device of claim 9, wherein the heated member and the pressure roller are rotatable at angular rates.

11. The output imaging device of claim 10, wherein the controller sets the film dwell time of at least one photothermographic element of the photothermographic elements by decreasing the angular rates of the heated member and pressure roller, thereby increasing the respective film dwell time for the photothermographic element.

12. The output imaging device of claim 10, wherein the controller sets the film dwell time of at least one photothermographic element by increasing the angular rates of the heated member and pressure roller, thereby decreasing the respective film dwell time for the photothermographic element.

13. The output imaging device of claim 9, wherein the controller periodically sets the film dwell time for at least one photothermographic element.

14. The output imaging device of claim 9, wherein the controller sets the film dwell time of each photothermographic element according to a series of discrete film dwell times stored in a lookup table.

15. The output imaging device of claim 9, wherein the controller sets the film dwell time of each photothermographic element according to a dwell compensation defined by the following equation:

$$D_{DWELL}=[D_{PREV}+(D_{MAX}-D_{PREV})*(1-e^{-T_H/R})]e^{-T_D/D}$$

where $D_{DWELL}$ equals the film dwell compensation, $D_{PREV}$ equals a dwell compensation for a previously developed photothermographic element, where $T_D$ is a period of thermal loss for the pressure roller equaling a time duration of the transfer of thermal energy to each photothermographic element, $T_H$ is a period of thermal gain for the pressure roller equaling a time duration of the transfer of thermal energy from the heated member to the pressure roller, D equals a decay time constant for the pressure roller, R equals a rise time constant for the pressure roller and $D_{MAX}$ is a predetermined maximum dwell compensation defined by the equation:

$$D_{MAX}=D_{SS}*[(1-e^{-T_D/R}*e^{-T_H/D})/((1-e^{-T_D/R})*e^{-T_H/D})]$$

where $D_{SS}$ is an optimal dwell compensation for steady-state conditions.

16. The output imaging device of claim 9, wherein the controller continuously sets the film dwell time of each photothermographic element according to a dwell compensation defined by the following equation:

$$D_{DWELL}=D_{ENTER}+((D_{MAX}-D_{ENTER})*(1e^{-t/R}))$$

where $D_{ENTER}$ equals a film dwell time calculated when the heated member received the photothermographic element, t equals a time elapsed since the heated member received the photothermographic element, R equals a rise time constant for the pressure roller and $D_{MAX}$ is a predetermined maximum dwell compensation defined by the equation:

$$D_{MAX}=D_{SS}*[(1-e^{-T_D/R}*e^{-T_H/D})/((1-e^{-T_D/R})*e^{-T_H/D})],$$

where $T_D$ is a period of thermal loss for the pressure roller equaling a time duration of the transfer of thermal energy to each photothermographic element, $T_H$ is a period of thermal gain for the pressure roller equaling a time duration of the transfer of thermal energy from the heated member to the pressure roller, R equals a rise time constant for the pressure roller and D equals a decay time constant for the pressure roller.

* * * * *